US006515231B1

(12) United States Patent
Strøbech et al.

(10) Patent No.: US 6,515,231 B1
(45) Date of Patent: Feb. 4, 2003

(54) ELECTRICALLY INSULATING MATERIAL, METHOD FOR THE PREPARATION THEREOF, AND INSULATED OBJECTS COMPRISING SAID MATERIAL

(75) Inventors: Esben Rune Strøbech, Hørsholm (DK); Bjørn Winther-Jensen, Copenhagen (DK); Kristian Glejbøl, Albertslund (DK)

(73) Assignee: Nkt Research Center A/S, Brondby (DK)

( * ) Notice: Subject to any disclaimer, the term of this patent is extended or adjusted under 35 U.S.C. 154(b) by 0 days.

(21) Appl. No.: 09/486,678

(22) PCT Filed: Sep. 9, 1998

(86) PCT No.: PCT/DK98/00382

§ 371 (c)(1),
(2), (4) Date: May 30, 2000

(87) PCT Pub. No.: WO99/13477

PCT Pub. Date: Mar. 18, 1999

(30) Foreign Application Priority Data

Sep. 9, 1997 (DK) ..... 1027/97

(51) Int. Cl.[7] ..... H01B 17/60

(52) U.S. Cl. ..... 174/137 B; 174/138 C; 174/196

(58) Field of Search ..... 174/137 B, 110 R, 174/137 R, 138 C, 167, 168, 196

(56) References Cited

U.S. PATENT DOCUMENTS

| | | | | |
|---|---|---|---|---|
| 3,928,705 | A | 12/1975 | Loft et al. | 428/311 |
| 4,060,583 | A | 11/1977 | Groves et al. | 264/272 |
| 4,943,685 | A | 7/1990 | Reynaert | 174/19 |
| 5,218,011 | A | 6/1993 | Freeman | 523/173 |

FOREIGN PATENT DOCUMENTS

| | | |
|---|---|---|
| EP | 0174165 | 3/1986 |
| EP | 0661379 | 7/1995 |
| EP | 0749128 | 12/1996 |
| GB | 1371991 | 10/1974 |
| JP | 5467689 | * 5/1979 |
| JP | 8302113 | 11/1996 |
| WO | 8601634 | 3/1986 |
| WO | 9627885 | 9/1996 |

OTHER PUBLICATIONS

Patent Abstract of Japan Publication No. 5467689 dated May 31, 1979.*

Derwent English abstract and translation of JP8302113 dated Nov. 19, 1996.

* cited by examiner

*Primary Examiner*—Dean A. Reichard
*Assistant Examiner*—W. David Walkenhorst
(74) *Attorney, Agent, or Firm*—Ladas & Parry

(57) ABSTRACT

An electrically insulating material including a continuous phase of a thermoplastic polymer and an additional phase incorporated therein of a liquid or easily meltable dielectric in the form of a wholly or partly interpenetrating network, and where the weight ratio of the polymer to dielectric is between 95:5 and 25:75.

27 Claims, No Drawings

ELECTRICALLY INSULATING MATERIAL, METHOD FOR THE PREPARATION THEREOF, AND INSULATED OBJECTS COMPRISING SAID MATERIAL

This application is a 371 of PCT/DK98/00382, filed Sep. 9, 1998.

An electrically insulating material, method for the preparation thereof, and insulated objects comprising said material.

The present invention relates to an electrically insulating material comprising a thermoplastic polymer and a dielectric.

It is known to insulate high-voltage DC cables with paper impregnated with dielectric oil. The preparation of such insulated cables is cumbersome and time-consuming, as it comprises a number of steps, such as wrapping the paper round the electrical conductor, drying, impregnating the paper under heating, and cooling the insulation to ambient temperature. Such cables can also be used for alternating current.

By using the known insulations, local charge effects which may cause breakdown can be avoided, but the resulting cables are sensitive to quenching, and the operating temperatures should not exceed about 80° C.

GB patent No. 1.371.991 discloses an insulation material, which is prepared by impregnating a porous, electrically insulating polymeric film with a dielectric fluid, followed by a heat-shrinkage of the polymeric film in view of encapsulating the dielectric fluid. The use of the known insulation material for insulating e.g. high-voltage cables is slow as, like the first-mentioned insulating method, it presupposes that the impregnated polymeric film is wound round the electrical conductor.

It is also known to insulate high-voltage AC cables with an insulating insulation layer prepared by extrusion of a polymer, such as polyethylene or cross-linked polyethylene.

It has not been possible to use such insulation layers of a polymer for insulating high-voltage DC cables, i.a. because during cooling to ambient temperature at operating conditions, local charge effects are accumulated, thus entailing risk of breakdown.

Also, it is known to use various types of gels for insulation and/or field equalization.

U.S. Pat. No. 4,943,685 discloses the use of a gel formed from a lightly cross-linked polymer and insulating fluid, such as a mineral oil, for injecting into e.g. cable splices or cable shoes, so that the gel fills out the void around the conductor and acts as insulation.

U.S. Pat. No. 5,218,011 discloses the use of a gel composition comprising a fluid, a thickener, and a water absorbent polymer for incorporation as filler in cavities and in electrical cables. The main purpose of the presence of such a gel is to prevent entry of water, which i.a. is achieved in that the gel itself forms a barrier. If water does enter past this barrier, the water absorbent polymer is activated, and the water is absorbed. This type of gel is mainly used in connection with low direct voltages.

WO 86/01634 discloses use of a gelloid composition comprising a polymer, in which a fluid is dispersed, and and optionally a filler, for field equalization in connection with electrical devices. The composition is especially well-suited for use at high voltages.

It is a common feature of these types of gels that they have no mechanical strength, for which reason they are most unfit for formation of a dimensionally stable insulation layer. Typically, it is the purpose of the gel to act as a mass which displaces air, as air is poorly insulating. As regards the gels mentioned in U.S. Pat. No. 5,218,011 and WO 86/01634 there is the additional disadvantage that the particular gel in itself has no particular insulating effect, for which reason an additional insulation layer must typically be used.

JP 8302113A discloses the use of an ethylene-propylene rubber compounded with at least one compound selected from polybutene, polybutadiene, polysioprene, and butyl rubber, inorganic fillers, and organic peroxides for the preparation of an insulation material without use of added oil.

Finally, WO 96/27885 discloses use of a composition comprising a polypropylene polymer or copolymer, polyethylene wax, and coated magnesium hydroxide as insulation or outer sheath for wires and cables. Such a composition is easily extrudable, and the wax content ensures a smooth and wear-resistant surface.

Use of the above composition for high-voltage is, however, inexpedient because of the high content of magnesium hydroxide added in view of the fire retarding effect of the substance.

It is the object of the present invention to provide a material which possesses sufficient insulating capacity for it to be used for both DC and AC insulation in connection with high-voltage, and which is easily converted so as to form a desired insulation layer.

This object and other objects, which will be described in the following, are obtained with the insulation material according to the invention, which is characterized in that the thermoplastic polymer forms a continuous phase incorporating an additional phase of a liquid or easily meltable dielectric in the form of a wholly or partly interpenetrating network, and that the weight ratio of polymer to dielectric is between 95:5 and 25:75.

When using an electrically insulating material for e.g. high-voltage insulation, a temperature increase normally occurs, whereby the dielectric, if not already liquid, melts. Hereby a structure emerges comprising a solid network of polymer filled with liquid dielectric, which thereby gets to act as a mobile phase in the solid polymer network.

The presence of this mobile phase seems to prevent local charge effects, which in the known materials may cause breakdown, from arising, and without this phase inexpediently influencing the main structure and consequently the strength of the insulation material.

Examples of useful thermoplastic polymers include polyolefines, acetate polymers, cellulose polymers, polyesters, polyketones, polyacrylates, polyamides, and polyamines. The polymers may be homo-, co- or ter-polymers. As co-monomers use can be made of various compounds with functional groups, such as epoxides, vinyls, amines, anhydrides, isocyanates, and nitriles. Mixtures of two or more polymers can also be used.

To avoid exudation of dielectric after the preparation of the insulation material, it is preferred to use low-crystalline polymers.

The liquid dielectric is preferably a mineral or synthetic oil, or a mixture of both. Low-viscosity as well as high-viscosity oils may be used.

Examples of use as dielectric oils include polyisobutylene, naphthenic, polyaromatic, and alpha-olefine containing oils, as well as silicone oils.

Examples of easily meltable dielectrics are wax and low molecular polymers.

In this context, the expression "easily meltable" should be taken to mean that the dielectric melts/softens at a lower temperature than the melting/softening temperature for the thermoplastic polymer.

The invention also relates to a method for the preparation of the electrically insulating material described above. This method is characterized in that the thermoplastic polymer and a liquid or easily meltable dielectric in a weight ratio from 95:5 to 25:75 of polymer to dielectric are mixed under heating to a sufficiently high temperature for melting both polymer and dielectric, that the mixture is optionally formed to a shape, and that it is cooled to ambient temperature. Hereby an insulation material is obtained which is dimensionally stable at temperatures of use, and consequently can be used without cross-linking as insulation material on e.g. high-voltage cables.

During the mixing and the heating of the thermoplastic polymer and the liquid or meltable dielectric, a liquid-in-liquid suspension is obtained, where the polymer as a result of its comparatively high viscosity predominantly forms a continuous phase, in which the liquid dielectric forms a similarly continuous, interpenetrating phase. It is presumed that a corresponding backbone structure is obtained after cooling the mixture to ambient temperature, however, with the difference that the polymer after having again assumed solid state forms a network containing a wholly or partly interpenetrating network of liquid of solidified dielectric.

It is understood that the said interpenetrating network is formed at microscopic level, and, as it is, is not comparable with network at molecular level provided e.g. by cross-linking of polymer chains and/or formation of a gel structure.

The weight ratio of polymer to dielectric is, as mentioned, from 95:5 to 25:75. Particularly preferred ratios are from 90:10 to 50:50, and in particular from 90:10 to 75:25.

It may be advantageous to reinforce the polymer network in the insulating material according to the invention by evoking in the said mixture a cross-linking in the polymer. Such cross-linking can e.g. be obtained by radiation treatment or by admixing a cross-linking agent, e.g. in the form of a triallyl cyanurate, silanes or peroxides.

The mixture of polymer and dielectric can be added with one or more additives and/or fillers. For example, carbon black, titanium dioxide, wood powder or cellulose derivatives can be used for equalizing electrical fields.

The temperature to which the mixture is heated depends on the melting/softening point of the thermoplastic polymer, and should preferably lie more than 10° C. over this temperature. For α-olefines a temperature of up to 160° C. is typically used, and for e.g. polyamides, cellulose polymers, and polyketones a temperature up to 230° C.

The thermoplastic polymer and the dielectric can be mixed and heated batch-wise or continuously, e.g. using an extruder. The mixed mass can be granulated and used as starting material for formation of desired insulation layers. For example, it can be extruded directly onto an electrical conductor so as to form an insulation layer thereon, or by a multi-step extrusion of the electrically insulating material optionally added with carbon black or another additive. The additive can also be added to the polymer prior to the mixing thereof with the dielectric.

Injection moulding, thermoforming or the like may also be used for the shaping.

The mixing and the heating as well as the extrusion onto a conductor may also take place in one step.

The invention further relates to objects, such as cables insulated with the electrically insulating material described above. Such insulated cables can be used for both direct current and alternating current, preferably for direct current, and at voltages from 220 V to 10 MV. Preferred uses are for voltages greater than 5 kV, as the material at high field strengths is capable of maintaining its good electrical properties.

The insulation material described can also be used for other insulating purposes, e.g. for insulating terminations, cable splices, cable terminals, transformer insulation, for the preparation of dielectric components, for use in X-ray generators, and for other high-voltage purposes.

In the following the invention is described in more detail with reference to the examples below.

EXAMPLE 1

40 parts by volume of naphthenic oil with a viscosity at 25° C. of 12 cp were heated to 150° C. under stirring with a stirrer having a rotational speed of 30 rpm/min. Then 60 parts by volume of alpha-olefine containing polymer with an MFI of 0.6 g/10 min and a melting temperature of 142° C. were added. Mixing was for 4 min at 150° C. The mixture thus obtained was cooled and granulated at ambient temperature. The granulate was introduced into an extruder and extruded in the form of a coating onto an electrical conductor at a temperature of 140–160° C.

The insulating coating thus prepared was thermally stable and mechanically stable at temperatures up to about 80° C. The coating consisting of two interpenetrating networks did not exudate oil at a temperature of 80° C. and a superpressure of 1 bar.

By examining the breakdown strength of the insulating coating it was established that this strength was at least as high as for an insulating coating consisting of oil impregnated paper.

EXAMPLE 2

An insulating coating was prepared on an electrical conductor by a method corresponding to that described in example 1, but using polyisobutylene oil instead of a naphthenic oil.

The coating obtained had essentially the same properties as the coating according to example 1.

EXAMPLE 3

An insulating coating was prepared on an electrical conductor by a method corresponding to that described in example 1, with the exception that 70 parts by volume of polymer and 30 parts by volume of oil were used.

EXAMPLE 3a

An insulating coating was prepared on an electrical conductor by a method corresponding to that described in example 1, however using 80 parts by volume of polymer and 20 parts by volume of oil.

The coatings obtained had essentially the same properties as the coating according to example 1.

Measurement of rate of local charging and decharging for the insulation materials prepared in examples 1, 3 and 3a was made by means of Pulsed Electro Accoustic Method (PEA). Test specimens were prepared from semi-conductor and have a thickness of 2 mm. Charging is effected with 20 kV DC voltage, and charging and decharging are for 24 hours. Measurements are made without impressed voltage on the test specimen.

Standard decharging rates for the materials from examples 1, 3 and 3a are stated in table 1 and compared with conventional AC PEX insulation and oil impregnated paper insulation.

| | PEX | Oil/paper | Polymer* | Ex. 1 | Ex. 3 | Ex. 3a |
|---|---|---|---|---|---|---|
| Unit Decharging time | Min. >500 | Min. 200 | Min. >500 | Min. 30 | Min. 50 | Min. 50 |

*alpha-olefinic polymer used in examples 1–3 and 3a Table 1. Decharging rates for different dielectrics.

EXAMPLE 4

An insulating coating was prepared on an electrical conductor by a method corresponding to that described in example 1, but using 10 parts by volume of paraffinic wax with melting interval of 57–60° C. from Merck, 80 parts of extrudable LDPE (from Dow), and 10 parts of powdered additive consisting of wood with a maximum diameter of 65 μm.

The insulation material obtained has essentially the same properties as the insulation in example 1.

EXAMPLE 5

An insulating coating was prepared on an electrical conductor by a method corresponding to that described in example 1, but using 10 parts by volume of polycyclic oil with a density of 1.04/cm$^3$, 89 parts of ethylene vinyl acetate (24% vinyl acetate) with an MFI of 3 g/10 min (2.16 kg/190° C., ASTM D1238), and 1 part of powdered additive consisting of alumina trihydrate (Apyral 40 from Nabaltec) with a grain size diameter or about 1.5 μm.

The insulation material obtained has essentially the same properties as the insulation in example 1.

EXAMPLE 6

An insulating coating was prepared on an electrical conductor by a method corresponding to that described in example 1, but using 5 parts by volume of chemically pure oleic acid, 94.8 parts of ethylene acrylate with 2% maleic anhydride (Lotader 2100 from Elf Atochem), and 0.2 parts of powdered additive consisting of chemically pure titanium dioxide.

The insulating material obtained has essentially the same properties as the insulation in example 1.

EXAMPLE 7

15 parts by volume of epoxidized soybean oil were mixed with 85 parts of LDPE cable insulation polyethylene, into which 1.5% of dicumyl peroxide had been premixed. The mixing took place as described in example 1, however, mixing was at 135° C. The insulation material thus prepared was cross-linked by heating to 180° C. under pressure (10 bar).

The coating material obtained has essentially the same properties as the insulation in example 1.

What is claimed is:

1. An electrically insulating material comprising a thermoplastic polymer and a dielectric having a weight ratio of polymer to dielectric between 95:5 and 25:75, wherein the thermoplastic polymer forms a network of solid polymer filled with the dielectric, the dielectric being a liquid or a solid that melts or softens at a lower temperature than the thermoplastic polymer such that the dielectric acts as a mobile phase in the solid polymer network, said insulating material maintaining its dielectric properties when subjected to voltages greater than 5 kV.

2. An electrically insulating material according to claim 1, wherein the thermoplastic polymer forms a continuous phase incorporating the dielectric in the form of a wholly or partly interpenetrating network.

3. An electrically insulating material according to claim 1, wherein the thermoplastic polymer is selected from the group consisting of polyolefins, acetate polymers, cellulose polymers, polyesters, polyketones, polyacrylates, polyamides, polyamines, and epoxides, or a mixture of two or more of the group.

4. An electrically insulating material according to claim 1, wherein the thermoplastic polymer is low-crystalline.

5. An electrically insulating material according to claim 1, wherein the dielectric is a liquid selected from the group consisting of mineral oil and synthetic oil.

6. An electrically insulating material according to claim 5, wherein the dielectric is an oil selected from the group consisting of polyisobutylene oils, naphthalenic oils, alpha-olefinic oils, and silicone oils.

7. An electrically insulating material according to claim 1, wherein the dielectric is a wax.

8. An electrically insulating material according to claim 1, wherein the weight ratio of polymer to dielectric is between 90:10 and 50:50.

9. An electrically insulating material according to claim 8, wherein the weight ratio of polymer to dielectric is between 90:10 and 75:25.

10. An electrically insulating material according to claim 1, wherein the material is thermally and mechanically stable at a temperature of 80° C.

11. A method for the preparation of the electrically insulating material of claim 1 comprising mixing the thermoplastic polymer and the dielectric at a weight ratio between 95:5 and 25:75 of polymer to dielectric under heating to a sufficiently high temperature for melting the thermoplastic polymer, optionally shaping the mixture and cooling the mixture to ambient temperature.

12. A method according to claim 11, wherein the thermoplastic polymer is cross-linked during the mixing under heating.

13. A method according to claim 12, comprising introducing a cross-linking agent into the mixture of thermoplastic polymer and dielectric.

14. A method according to claim 11, comprising adding an additive to the mixture of thermoplastic polymer and dielectric.

15. A method according to claim 14, wherein the additive is selected from the group consisting of carbon black, titanium dioxide, aluminum hydroxide, cellulose derivatives and wood powder.

16. A method according to claim 11, wherein the thermoplastic polymer is mixed with an additive or a filler prior to being mixed with the dielectric.

17. A method according to claim 11, wherein the mixture is shaped by extrusion.

18. A method according to claim 17, wherein the mixture is extruded as an insulation layer onto an electrical conductor.

19. An electrically insulated object comprising an electrical conductor surrounded by the electrically insulation material according to claim 1.

20. An electrically insulated object according to claim 19 wherein the electrical conductor is for voltages greater than 36 kV.

21. An electrically insulated object according to claim 19, wherein the electrical conductor is for voltages greater than 150 kV.

22. An electrically insulated object according to claim 19, wherein the electrical conductor is for voltages greater than 400 kV.

23. A method for conducting electricity comprising:

a) providing the electrically insulated object of claim 19; and b) passing a direct current through the object at a voltage greater than 5 kV.

24. A method comprising insulating a cable with the electrically insulated material of claim 1.

25. A method comprising insulating a cable assembly with the electrically insulated material of claim 1.

26. A method comprising preparing a dielectric component with the electrically insulated material of claim 1 and incorporating said component into a piece of high-voltage equipment.

27. An electrically insulating material comprising a thermoplastic polymer and a dielectric having a weight ratio of polymer to dielectric between 95:5 and 25:75, wherein the thermoplastic polymer forms a network of solid polymer filled with the dielectric, said dielectric comprising a liquid phase or a solid phase that melts or softens at a lower temperature than the thermoplastic polymer and is able to act as a mobile phase in the solid polymer network.

* * * * *

UNITED STATES PATENT AND TRADEMARK OFFICE

CERTIFICATE OF CORRECTION

PATENT NO. : 6,515,231 B1
DATED : February 4, 2003
INVENTOR(S) : Esben Rune Strobech It is certified that error appears in the above-identified patent and that said Letters Patent is hereby corrected as shown below:

Title page,
Item [73], Assignee, "Nkt" should read -- NKT --.

Signed and Sealed this

Seventeenth Day of June, 2003

JAMES E. ROGAN
*Director of the United States Patent and Trademark Office*